US010204556B2

(12) United States Patent
Liu

(10) Patent No.: US 10,204,556 B2
(45) Date of Patent: Feb. 12, 2019

(54) DISPLAY PANEL AND DRIVING METHOD THEREOF AND DISPLAY DEVICE

(71) Applicant: BOE TECHNOLOGY GROUP CO., LTD., Beijing (CN)

(72) Inventor: Ying Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 260 days.

(21) Appl. No.: 15/208,182

(22) Filed: Jul. 12, 2016

(65) Prior Publication Data

US 2017/0243540 A1 Aug. 24, 2017

(30) Foreign Application Priority Data

Feb. 22, 2016 (CN) ..... 2016 1 0096712

(51) Int. Cl.
*G09G 3/3258* (2016.01)

(52) U.S. Cl.
CPC ..... *G09G 3/3258* (2013.01); *G09G 2310/08* (2013.01); *G09G 2330/021* (2013.01); *G09G 2330/12* (2013.01)

(58) Field of Classification Search
CPC ..... G09G 2310/08; G09G 2330/021; G09G 2330/12; G09G 3/3258
See application file for complete search history.

(56) References Cited

U.S. PATENT DOCUMENTS

2009/0140661 A1 6/2009 Park et al.
2012/0127213 A1* 5/2012 Park ..... G09G 3/006 345/690
2012/0217823 A1* 8/2012 Shimizu ..... G09G 5/006 307/130
2012/0293562 A1 11/2012 Park
2015/0155779 A1 6/2015 Kwon et al.
2017/0271866 A1 9/2017 Park

FOREIGN PATENT DOCUMENTS

CN 102479479 A 5/2012
CN 102832805 A 12/2012
CN 103312164 A 9/2013

OTHER PUBLICATIONS

Chinese Office Action in Chinese Application No. 201610096712.7, dated Sep. 5, 2017 with English translation.

* cited by examiner

*Primary Examiner* — Viet D Pham
(74) *Attorney, Agent, or Firm* — Collard & Roe, P.C.

(57) ABSTRACT

A display panel includes: a display unit, including a pixel circuit; a first power transmission line and a second power transmission line; a DC-DC circuit, configured to provide a first supply voltage and a second supply voltage for the pixel circuit through the first power transmission line and the second power transmission line respectively; a control circuit, configured to control the DC-DC circuit to start to provide the second supply voltage after the DC-DC circuit starts to provide the first supply voltage, where a time interval between a start of providing the second supply voltage and a start of providing the first supply voltage is no less than a time period to display one image frame; and a start-up short detection circuit, configured to determine whether a short-circuit fault occurs between the first power transmission line and the second power transmission line.

14 Claims, 4 Drawing Sheets

DISPLAY PANEL AND DRIVING METHOD THEREOF AND DISPLAY DEVICE

CROSS REFERENCE TO RELATED APPLICATIONS

Applicant claims priority under 35 U.S.C. § 119 of Chinese Application No. 201610096712.7 filed on Feb. 22, 2016, the disclosure of which is incorporated by reference.

TECHNICAL FIELD

Embodiments of the present disclosure relate to a display panel and a driving method thereof and a display device.

BACKGROUND

According to different driving modes for organic light emitting diodes, Organic Light Emitting Diode (OLED) display panels can be divided into passive-matrix OLED (PMOLED) display panels and active-matrix OLED (AMOLED) display panels. For example, an AMOLED display panel is a favorable emerging display technology due to characteristics such as small thickness, a light weight, auto-luminescence, a low driving voltage, high efficiency, high contrast, high color saturation, a fast response speed, bendable performance or the like.

SUMMARY

Embodiments of the present disclosure provide a display panel, which includes:

a display unit, including a pixel circuit;

a first power transmission line and a second power transmission line which are coupled with the pixel circuit of the display unit;

a direct current-direct current (DC-DC) circuit, configured to provide a first supply voltage for the pixel circuit through the first power transmission line and to provide a second supply voltage for the pixel circuit through the second power transmission line;

a control circuit, configured to control the DC-DC circuit to start to provide the second supply voltage for the pixel circuit after the DC-DC circuit starts to provide the first supply voltage for the pixel circuit, where a time interval between a start of providing the second supply voltage for the pixel circuit and a start of providing the first supply voltage for the pixel circuit is no less than a time period for the display unit to display one image frame; and a start-up short detection circuit, configured to determine whether a short-circuit fault occurs between the first power transmission line and the second power transmission line by detecting a voltage of the second power transmission line.

Embodiments of the present disclosure provide a display panel, which includes:

a display unit, including a pixel circuit;

a first power transmission line and a second power transmission line which are coupled with the pixel circuit of the display unit;

a DC-DC circuit, configured to provide a first supply voltage for the pixel circuit through the first power transmission line and to provide a second supply voltage for the pixel circuit through the second power transmission line;

a control circuit, configured to control the DC-DC circuit to start to provide the first supply voltage for the pixel circuit after the DC-DC circuit starts to provide the second supply voltage for the pixel circuit; and a start-up short detection circuit, configured to determine whether a short-circuit fault occurs between the first power transmission line and the second power transmission line by detecting a voltage of the first power transmission line.

Embodiments of the present disclosure provide a display device including the display panel described above.

Embodiments of the present disclosure provide a driving method for driving the display panel, which includes:

after the DC-DC circuit starts to provide the first supply voltage for the pixel circuit of the display unit through the first power transmission line, controlling the DC-DC circuit to start to provide the second supply voltage for the pixel circuit through the second power transmission line, where a time interval between a start of providing the second supply voltage for the pixel circuit and a start of providing the first supply voltage for the pixel circuit is no less than a time period for the display unit to display one image frame; and determining whether a short-circuit fault occurs between the first power transmission line and the second power transmission line by detecting a voltage of the second power transmission line.

Embodiments of the present disclosure provide a driving method for driving the display panel, which includes:

controlling the DC-DC circuit to start to provide the first supply voltage for the pixel circuit through the first power transmission line after the DC-DC circuit starts to provide the second supply voltage for the pixel circuit of the display unit through the second power transmission line; and determining whether a short-circuit fault occurs between the first power transmission line and the second power transmission line by detecting a voltage of the first power transmission line.

BRIEF DESCRIPTION OF THE DRAWINGS

In order to illustrate the technical solutions in the embodiments of the present disclosure or the existing arts more clearly, the drawings need to be used in the description of the embodiments or the existing arts will be briefly described in the following; it is obvious that the drawings described below are only related to some embodiments of the present disclosure. For one ordinary skilled person in the art, other drawings can be obtained according to these drawings without making additional inventive work.

DETAILED DESCRIPTION

Hereafter, the technical solutions of the embodiments of the present disclosure will be described in a clearly and fully understandable way in connection with the drawings related to the embodiments of the invention. It is obvious that the described embodiments are just a part but not all of the embodiments of the present disclosure. The drawings mentioned in the embodiments of the present disclosure are only to exemplarily illustrate the technical solutions of the present disclosure. The other drawings obtained from the drawings of the embodiments of the present disclosure through simple transformations should be within the scope of the present disclosure.

Figure 1:
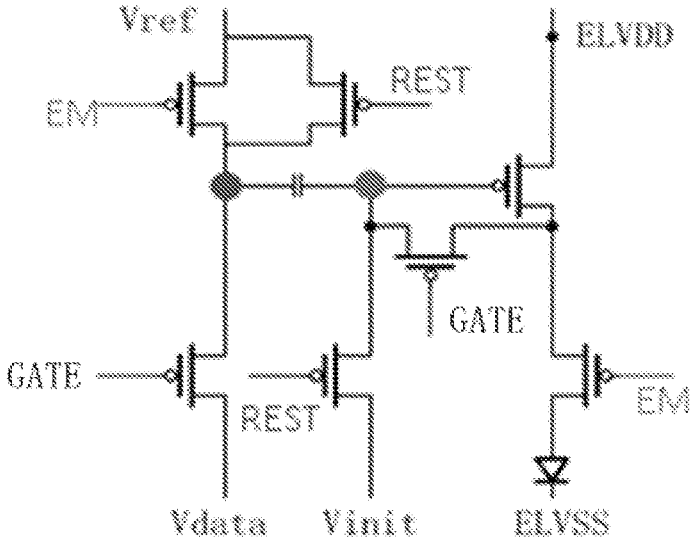
FIG. 1 is a structural diagram of a pixel circuit in a normally-black mode AMOLED display panel in related technologies.
Figure 2:
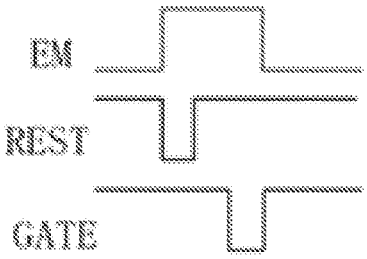
FIG. 2 is a sequence diagram of the pixel circuit in FIG. 1.
Figure 3:
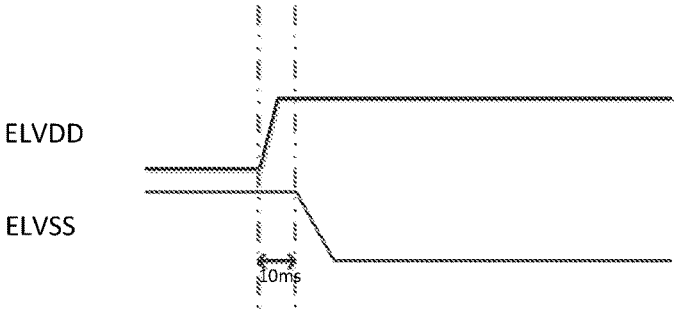
FIG. 3 is a power supply sequence diagram of a DC-DC circuit in an AMOLED display panel in related technologies.

An AMOLED display panel generally uses a direct current-direct current (DC-DC) circuit to provide a corresponding driving voltage for a pixel circuit thereof, and uses a Start-up Short Detection (SSD) circuit to detect whether a short-circuit fault occurs in the display panel. However, for a normally-black mode AMOLED display panel, a common panel refresh rate is 60 Hz, and a time period for one frame is about 1/60=16.7 ms. A pixel circuit of the display panel is shown in FIG. 1, a sequence diagram of the pixel circuit is shown in FIG. 2, and a power supply sequence diagram of a DC-DC circuit is shown in FIG. 3. As shown in FIG. 3, firstly, a first supply voltage ELVDD is provided for the pixel circuit through a first power transmission line; then a second supply voltage ELVSS is provided for the pixel circuit through a second power transmission line, and a power-up interval between the first supply voltage ELVDD and the second supply voltage ELVSS is td=10 ms. While it is started to provide the second supply voltage ELVSS for the pixel circuit, the SSD circuit determines whether a short-circuit fault occurs by detecting a voltage of the second power transmission line. In the above process, when the first power transmission line is suddenly powered up, a first frame of the display panel becomes bright, causing an electric potential of the second power transmission line to be pulled up which may easily result in occurrence of an SSD check error. The SSD check error can trigger a start of an SSD function, causing the DC-DC circuit to switch off its output.

A display panel provided by an embodiment of the present disclosure can avoid output of the DC-DC circuit being switched off because of the SSD check error.

Figure 4:
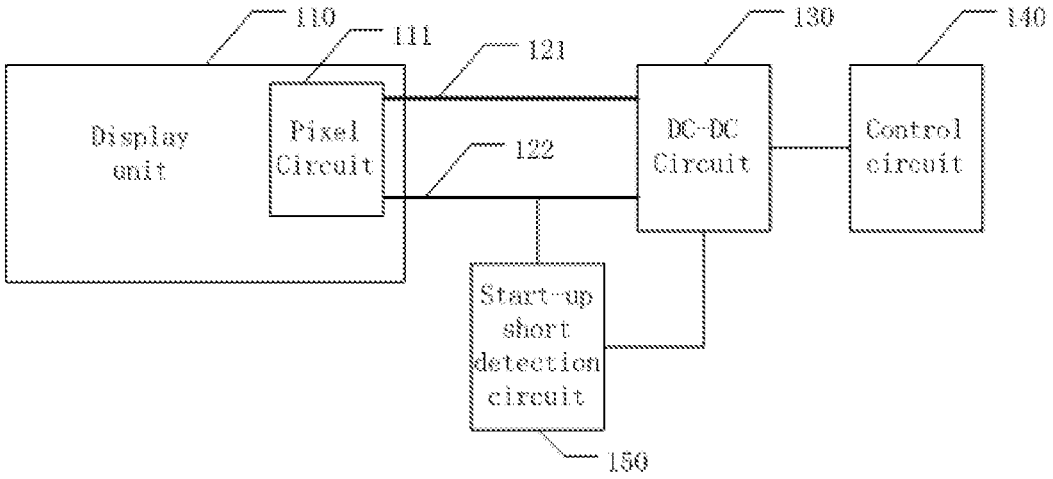
FIG. 4 is a schematic diagram of a display panel provided by an embodiment of the present disclosure.

FIG. 4 is a schematic diagram of a display panel provided by an embodiment of the present disclosure. The display panel includes: a display unit 110 that includes one or more pixel circuits 111; a first power transmission line 121 and a second power transmission line 122 which are coupled with a pixel circuit 111 of the display unit 110; a DC-DC circuit 130; a control circuit 140; and a start-up short detection circuit 150.

For example, the DC-DC circuit 130 is configured to providing a first supply voltage ELVDD for the pixel circuit of the display unit 110 through the first power transmission line 121 and providing a second supply voltage ELVSS for the pixel circuit of the display unit 110 through the second power transmission line 122. For example, the DC-DC circuit 130 includes an output port for outputting the ELVDD and another output port for outputting the ELVSS, where the output port for outputting the ELVDD is connected with the first power transmission line, and the other output port for outputting the ELVSS is connected with the second power transmission line.

For example, the control circuit 140 is configured to control the DC-DC circuit to start to provide the second supply voltage ELVSS for the pixel circuit through the second power transmission line after the DC-DC circuit starts to provide the first supply voltage ELVDD for the pixel circuit through the first power transmission line. Besides, a time interval between the start of providing the second supply voltage ELVSS for the pixel circuit and the start of providing the first supply voltage ELVDD for the pixel circuit is no less than a time period used by the display unit to display one image frame.

For example, the start-up short detection circuit 150 is configured to determine whether a short-circuit fault occurs between the first power transmission line and the second power transmission line by detecting a voltage of the second power transmission line. When the DC-DC circuit starts to provide the second supply voltage ELVSS for the pixel circuit, simultaneously the start-up short detection circuit 150 detects the voltage of the second power transmission line so that whether a short-circuit fault occurs between the first power transmission line and the second power transmission line can be determined.

In the display panel provided by the embodiment of the present disclosure, after the time period of displaying one image frame has passed since the start of providing the first supply voltage ELVDD, the second supply voltage ELVSS is provided for the pixel circuit, which can avoid the following problem that: because the first power transmission line of the display panel is suddenly powered up, a first frame becomes bright, causing an electric potential of the second power transmission line to be pulled up, and accordingly, the start-up short detection circuit makes a false short-circuit determination which may result in a failure to use the DC-DC circuit. The display panel provided by the embodiment of the present disclosure can make the DC-DC circuit to cope with more AMOLED pixel circuit designs, and can expand an application range of the DC-DC circuit.

Figure 5:
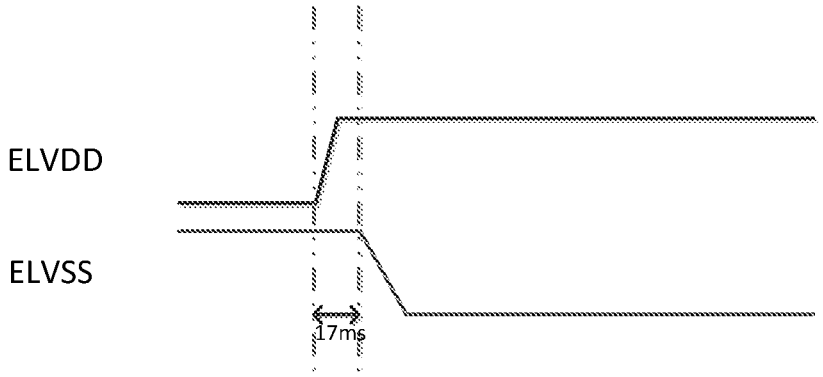
FIG. 5 is a power supply sequence diagram of a DC-DC circuit provided by an embodiment of the present disclosure.

For example, a time period for the display unit to display one image frame is 16.6 ms to 16.8 ms, and a time interval between a second moment (that is, a moment when the second supply voltage ELVSS is started to provide for the pixel circuit) and a first moment (that is, a moment when the first supply voltage ELVDD is started to provide for the pixel circuit) is 16.9 ms to 17.1 ms. For example, a power supply time sequence of the first supply voltage ELVDD and the second supply voltage ELVSS can be shown in FIG. 5, and the time interval shown in FIG. 5 is 17 ms.

Figure 6:
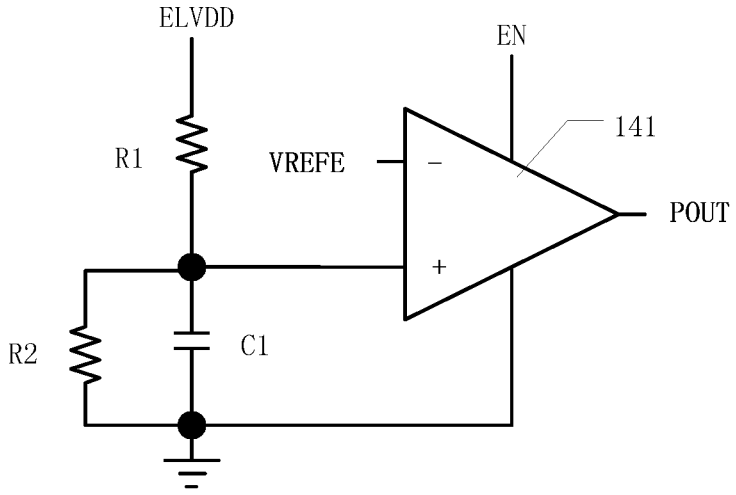
FIG. 6 is a schematic diagram of a control circuit provided by an embodiment of the present disclosure.

The display panel in the embodiment of the present disclosure can be implemented with increasing of a trigger signal output delay. For example, the control circuit can include a time-delay circuit (RC circuit) and a comparator 141, and a structure of the control circuit can be shown in FIG. 6. The time-delay circuit includes a capacitor C1, a first resistor R1, and a second resistor R2 connected with the capacitor C1 in parallel.

A first end of the capacitor C1 is grounded, and a second end of the capacitor C1 is connected with a first end of the first resistor R1 and a forward input port (e.g., a positive input port) of the comparator 141. A second end of the first resistor R1 is connected with the first power transmission line. A reverse input port (e.g., a negative input port) of the comparator 141 is configured to receive a reference voltage VREFE; a power port of the comparator 141 is configured to receive a trigger signal EN of the second supply voltage ELVSS; an output port (POUT) of the comparator 141 is connected with the DC-DC circuit and configured to output the trigger signal of the second supply voltage ELVSS into the DC-DC circuit when a voltage of the second end of the capacitor C1 is greater than the reference voltage.

For the above control circuit, when a voltage $V_+$ of the forward input port of the comparator 141 is greater than a voltage $V_-$ (e.g., the reference voltage VREFE) of the reverse input port of the comparator 141, an output signal of the output port of the comparator 141 is the trigger signal EN (e.g., POUT=EN) of the second supply voltage ELVSS, and thus, the DC-DC circuit can be controlled to start to provide the second supply voltage ELVSS for the pixel circuit through the second power transmission line. When the voltage $V_+$ of the forward input port of the comparator 141 is less than the voltage $V_-$ (e.g., the reference voltage VREFE,) of the reverse input port of the comparator 141, the output signal of the output port of the comparator 141 has a grounded potential (e.g., POUT=grounded potential GND), and thus, the DC-DC circuit does not output the second supply voltage ELVSS.

A delay of the voltage $V_+$ for the forward input port of the comparator 141 can be controlled by the time-delay circuit, so as to achieve an output delay of the trigger signal EN for the ELVSS, and a formula of a delayed time t is shown as follows:

$$t=R*C*1n[(ELVDD-V_+)/ELVDD]$$

where R represents a resistance value of the resistor R1, and C represents capacitance of the capacitor C1. An ultimate voltage of $V_+$ (e.g., a value of $V_+$ when the capacitor C1 is fully charged) is controlled by a ratio (R1/R2) between the resistance value of the resistor R1 to the resistance value of the resistor R2. In order to satisfy that when the capacitor C1 is fully charged, the voltage $V_+$ of the forward input port of the comparator 141 is greater than the reference voltage VREFE, the following condition needs to be satisfied: R1/R2<VREFE(ELVDD−VREFE).

Figure 7:
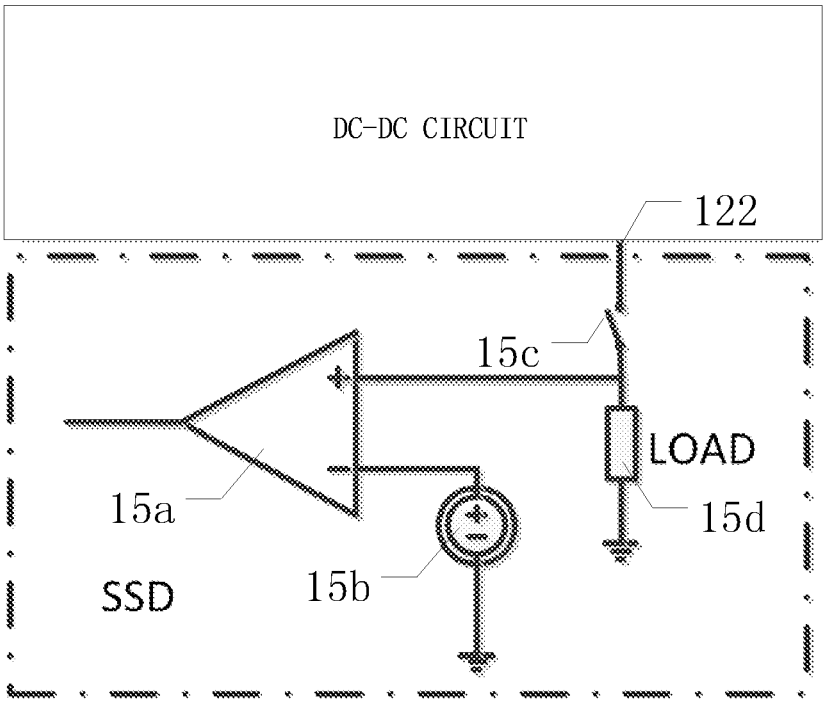
FIG. 7 is a schematic diagram of a start-up short detection circuit for detecting a short-circuit fault provided by an embodiment of the present disclosure.

The start-up short detection circuit 150 can be shown in FIG. 7, which includes a comparator 15*a*, a reference voltage providing unit 15*b*, a switch unit 15*c* and a load unit 15*d*. A forward input port of the comparator 15*a* is connected with a first end of the switch unit 15*c* and a first end of the load unit 15*d* (which is a capacitor or a resistor); a reverse input port of the comparator 15*a* is connected with the reference voltage providing unit 15*b;* a second end of the switch unit 15*c* is connected with the second power transmission line 122; and a second end of the load unit 15*d* is grounded. When the DC-DC circuit starts to provide the second supply voltage ELVSS for the pixel circuit, simultaneously the switch unit 15*c* is turned on, and the start-up short detection circuit 150 detects the voltage of the second power transmission line (that is, a load voltage of the load unit 15*d*). When the load voltage of the load unit 15*d* is greater than a reference voltage (e.g., 200 mV) provided by the reference voltage providing unit 15*b*, the start-up short detection circuit 150 determines that a short-circuit fault exists and outputs a shut-down signal to control the DC-DC circuit to stop outputting signals.

The display panel in the embodiment of the present disclosure can be a normally-black mode AMOLED display panel.

Figure 8:
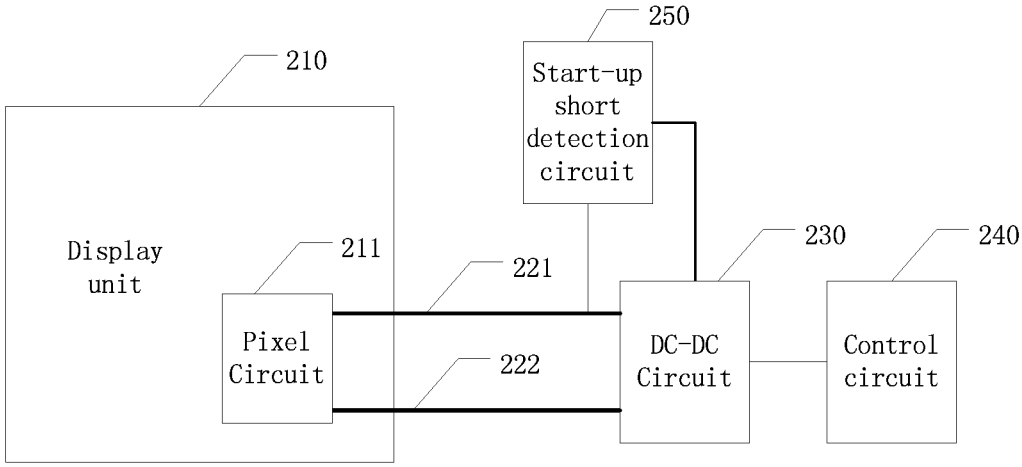
FIG. 8 is a schematic diagram of another display panel provided an embodiment of the present disclosure.

FIG. 8 is a schematic diagram of another display panel provided by an embodiment of the present disclosure. The display panel includes the display unit 210 that includes one or more pixel circuits 211; the first power transmission line 221 and the second power transmission line 222 which are coupled with a pixel circuit 211 of the display unit; the DC-DC circuit 230; the control circuit 240; and the start-up short detection circuit 250.

The DC-DC circuit 230 is configured to provide a first supply voltage ELVDD for the pixel circuit of the display unit through the first power transmission line and provide a second supply voltage ELVSS for the pixel circuit of the display unit through the second power transmission line. For example, the DC-DC circuit includes an output port for outputting the ELVDD and another output port for outputting the ELVSS, where the output port for outputting the ELVDD is connected with the first power transmission line, and the other output port for outputting the ELVSS is connected with the second power transmission line.

Figure 9:
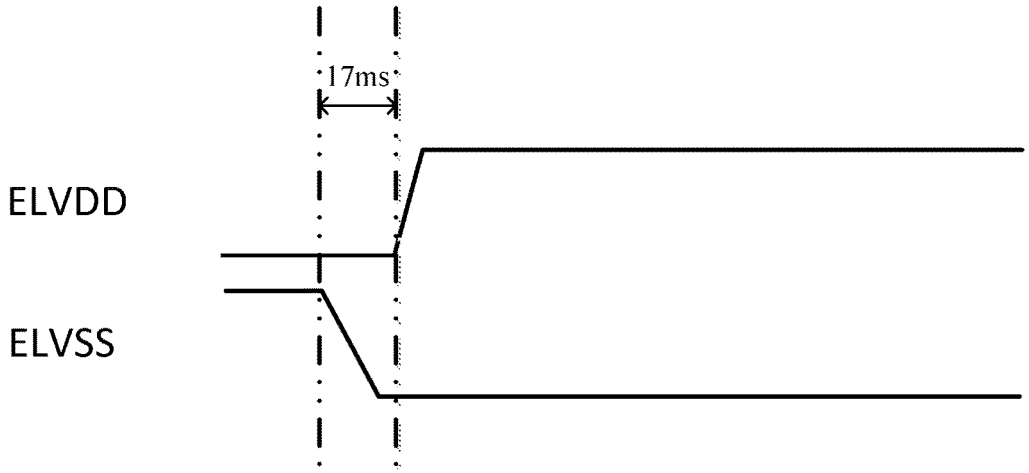
FIG. 9 is a power supply sequence diagram of another DC-DC circuit provided by an embodiment of the present disclosure.

The control circuit 240 is configured to control the DC-DC circuit to start to provide the first supply voltage ELVDD for the pixel circuit through the first power transmission line, after the DC-DC circuit starts to provide the second supply voltage ELVSS for the pixel circuit through the second power transmission line. A power supply time sequence of the first supply voltage ELVDD and the second supply voltage ELVSS can be shown in FIG. 9. For example, in FIG. 9 a time interval between the start of providing the second supply voltage and the start of providing the first supply voltage is 17 ms.

The start-up short detection circuit 250 is configured to determine whether a short-circuit fault occurs between the first power transmission line and the second power transmission line by detecting a voltage of the first power transmission line.

The display panel in the embodiment of the present disclosure can be a normally-black-mode AMOLED display panel. The first supply voltage ELVDD can be started to provide for the pixel circuit after the start of providing the second supply voltage ELVSS for the pixel circuit; and the start-up short detection circuit determines whether a short-circuit fault occurs between the first power transmission line and the second power transmission line by detecting the voltage of the first power transmission line. When the second supply voltage ELVSS is suddenly powered up, the voltage of the first power transmission line is not affected. Thus, the problem that the start-up short detection circuit makes a false short-circuit determination to cause a failure to use the DC-DC circuit can be avoided.

For example, a time period for the display unit to display one image frame is 16.7 ms. After 17 ms since the second supply voltage ELVSS is started to output, the first supply voltage ELVDD can be started to output. The SSD check is detected on the first power transmission line.

Figure 10:
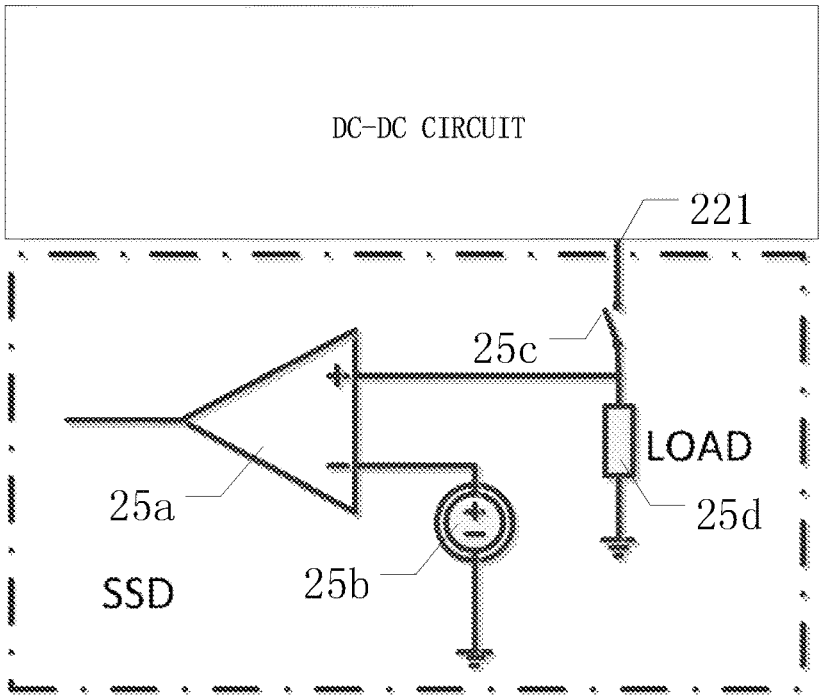
FIG. 10 is a schematic diagram of another start-up short detection circuit for detecting a short-circuit fault provided by an embodiment of the present disclosure.

The start-up short detection circuit 250 can be shown in FIG. 10, which includes a comparator 25*a*, a reference voltage providing unit 25*b*, a switch unit 25*c* and a load unit 25*d*. A forward input port of the comparator 25*a* is connected with a first end of the switch unit 25*c* and a first end of the load unit 25*d* (which is a capacitor or a resistor); a reverse input port of the comparator 25*a* is connected with the reference voltage providing unit 25*b;* a second end of the switch unit 25*c* is connected with the first power transmission line 221; and a second end of the load unit 25*d* is grounded. When the DC-DC circuit starts to provide the first supply voltage ELVDD for the pixel circuit, simultaneously the switch unit 25*c* is turned on, and the start-up short detection circuit 250 detects the voltage of the first power transmission line 221. When it is detected that the voltage of first power transmission line 221 is less than a reference voltage provided by the reference voltage providing unit 25*b,* the start-up short detection circuit 250 determines that a short-circuit fault exists and outputs a shut-down signal to control the DC-DC circuit to stop outputting signals.

An embodiment of the present disclosure further provides a display device including the above display panel. The display device provided by the embodiments of the present disclosure can be a notebook computer display screen, a display, a TV set, a digital photo frame, a mobile phone, a tablet computer or any product or part with a display function.

Besides, for the display panel shown in FIG. 4, an embodiment of the present disclosure further provides a driving method for the display panel, including:

after the DC-DC circuit starts to provide the first supply voltage ELVDD for the pixel circuit of the display unit through the first power transmission line, controlling the DC-DC circuit to start to provide the second supply voltage ELVSS for the pixel circuit through the second power transmission line, where a time interval between the start of providing the second supply voltage ELVSS for the pixel circuit and the start of providing the first supply voltage ELVDD for the pixel circuit is no less than the time period for the display unit to display one image frame; and determining whether a short-circuit fault occurs between the first power transmission line and the second power transmission line by detecting a voltage of the second power transmission line.

For example, the time period for the display unit to display one image frame can be 16.6 ms to 16.8 ms. The time interval between a second moment (that is, a moment when it is started to provide the second supply voltage ELVSS for the pixel circuit) and a first moment (that is, a moment when it is started to provide the first supply voltage ELVDD for the pixel circuit) can be 16.9 ms to 17.1 ms.

For the display panel shown in FIG. 8, an embodiment of the present disclosure further provides another driving method for the display panel, including:

after the DC-DC circuit starts to provide the second supply voltage ELVSS for the pixel circuit of the display unit through the second power transmission line, controlling the DC-DC circuit to start to provide the first supply voltage ELVDD for the pixel circuit through the first power transmission line; and determining whether a short-circuit fault occurs between the first power transmission line and the second power transmission line by detecting a voltage of the first power transmission line.

It should be noted that, in the drawings, the size of a layer or an area may be exaggerated for clarity of the drawings. Besides, it is understandable that if an element or a layer is said to be "under" another element or layer, it can be directly under the other element or an intermediate layer may exist therebetween. Besides, it is understandable that if a layer or an element is said to be "between" two layers or "between" two elements, it can be the only one layer or element between the two layers or two elements, or one or more intermediate layer or element can exist. Similar reference marks in the full text refer to the similar elements.

In the present disclosure, the relationship terms such as first, second, and so on are used only to distinguish an entity or operation from the other, and do not require or imply any practical relationship or sequence between these entities or operations. Moreover, the terms "include", "comprise" or its variation are intended to cover non-exclusive inclusion, so that a process, a method, an article or a device including a serious of elements not only includes these elements, but also includes other element not explicitly listed, or further includes the element instinct to the process, the method, the article or the device. The element corrected by the words "includes at least one" does not exclude the inclusion of other same element in the process, the method, the article or the device including the element.

The foregoing are merely specific embodiments of the invention, but not limitative to the protection scope of the invention. One skilled in the art could devise variations or replacements that within the scope and the spirit of the present invention, those variations or replacements shall belong to the protection scope of the invention. Thus, the protection scope of the invention shall be defined by the accompanying claims.

The present disclosure claims the benefits of Chinese patent application No. 201610096712.7, which was filed on Feb. 22, 2016 and is incorporated herein in its entirety by reference as part of this application.

The invention claimed is:

1. A display panel, comprising:

a display unit, including a pixel circuit;

a first power transmission line and a second power transmission line which are coupled with the pixel circuit of the display unit;

a direct current-direct current (DC-DC) circuit, configured to provide a first supply voltage for the pixel circuit through the first power transmission line and to provide a second supply voltage for the pixel circuit through the second power transmission line;

a control circuit, configured to control the DC-DC circuit to start to provide the second supply voltage for the pixel circuit after the DC-DC circuit starts to provide the first supply voltage for the pixel circuit, wherein a time interval between a start of providing the second supply voltage for the pixel circuit and a start of providing the first supply voltage for the pixel circuit is no less than a time period for the display unit to display one image frame; and a start-up short detection circuit, configured to determine whether a short-circuit fault occurs between the first power transmission line and the second power transmission line by detecting a voltage of the second power transmission line, when the DC-DC circuit starts to provide the second supply voltage for the pixel circuit.

2. The display panel according to claim 1, wherein:

the control circuit includes a time-delay circuit and a comparator, and the time-delay circuit includes a capacitor, a first resistor, and a second resistor connected with the capacitor in parallel; and a first end of the capacitor is grounded, a second end of the capacitor is connected with a first end of the first resistor and a forward input port of the comparator, a second end of the first resistor is connected with the first power transmission line, a reverse input port of the comparator is configured to receive a reference voltage, a power port of the comparator is configured to receive a trigger signal of the second supply voltage, and an output port of the comparator is configured to output the trigger signal of the second supply voltage into the DC-DC circuit when a voltage of the second end of the capacitor is greater than the reference voltage.

3. The display panel according to claim 1, wherein the time period for the display unit to display one image frame is 16.6 ms to 16.8 ms, and the time interval is 16.9 ms to 17.1 ms.

4. The display panel according to claim 1, wherein the display panel is an AMOLED display panel.

5. A display device, comprising the display panel according to claim 1.

6. A driving method for driving the display panel according to claim 1, comprising:

after the DC-DC circuit starts to provide the first supply voltage for the pixel circuit of the display unit through the first power transmission line, controlling the DC-DC circuit to start to provide the second supply voltage for the pixel circuit through the second power transmission line, wherein a time interval between a start of providing the second supply voltage for the pixel circuit and a start of providing the first supply voltage for the pixel circuit is no less than a time period for the display unit to display one image frame; and determining whether a short-circuit fault occurs between the first power transmission line and the second power transmission line by detecting a voltage of the second power transmission line.

7. The driving method of the display panel according to claim 6, wherein the time period for the display unit to display one image frame is 16.6 ms to 16.8 ms, and the time interval is 16.9 ms to 17.1 ms.

8. The display panel according to claim 1, wherein:

the start-up short detection circuit includes a comparator, a reference voltage providing unit, a switch unit and a load unit;

a forward input port of the comparator is connected with a first end of the switch unit and a first end of the load unit, and a reverse input port of the comparator is connected with the reference voltage providing unit;

a second end of the switch unit is connected with the second power transmission line; and a second end of the load unit is grounded.

9. The display panel according to claim 8, wherein:

when the DC-DC circuit starts to provide the second supply voltage for the pixel circuit, the switch unit is turned on and the start-up short detection circuit detects a load voltage of the load unit; and when the load voltage of the load unit is detected to be greater than a reference voltage provided by the reference voltage providing unit, the start-up short detection circuit determines that a short-circuit fault exists and outputs a shut-down signal to control the DC-DC circuit to stop outputting signals.

10. A display panel, comprising:

a display unit, including a pixel circuit;

a first power transmission line and a second power transmission line which are coupled with the pixel circuit of the display unit;

a direct current-direct current (DC-DC) circuit, configured to provide a first supply voltage for the pixel circuit through the first power transmission line and to provide a second supply voltage for the pixel circuit through the second power transmission line;

a control circuit, configured to control the DC-DC circuit to start to provide the first supply voltage for the pixel circuit after the DC-DC circuit starts to provide the second supply voltage for the pixel circuit; and a start-up short detection circuit, configured to determine whether a short-circuit fault occurs between the first power transmission line and the second power transmission line by detecting a voltage of the first power transmission line, when the DC-DC circuit starts to provide the first supply voltage for the pixel circuit.

11. The display panel according to claim 10, wherein the display panel is an AMOLED display panel.

12. A driving method for driving the display panel according to claim 10, comprising:

controlling the DC-DC circuit to start to provide the first supply voltage for the pixel circuit through the first power transmission line after the DC-DC circuit starts to provide the second supply voltage for the pixel circuit of the display unit through the second power transmission line; and determining whether a short-circuit fault occurs between the first power transmission line and the second power transmission line by detecting a voltage of the first power transmission line.

13. The display panel according to claim 10, wherein:

the start-up short detection circuit comprises a comparator, a reference voltage providing unit, a switch unit and a load unit;

a forward input port of the comparator is connected with a first end of the switch unit and a first end of the load unit, and a reverse input port of the comparator is connected with the reference voltage providing unit;

a second end of the switch unit is connected with the first power transmission line; and, a second end of the load unit is grounded.

14. The display panel according to claim 13, wherein:

when the DC-DC circuit starts to provide the first supply voltage for the pixel circuit, the switch unit is turned on and the start-up short detection circuit detects the voltage of the first power transmission line; and when a load voltage of the load unit is detected to be less than a reference voltage provided by the reference voltage providing unit, the start-up short detection circuit determines that a short-circuit fault exists and outputs a shut-down signal to control the DC-DC circuit to stop outputting signals.

* * * * *